United States Patent [19]

Suuronen

[11] Patent Number: 4,962,977

[45] Date of Patent: Oct. 16, 1990

[54] ELECTRIC FUSE

[75] Inventor: David E. Suuronen, Newburyport, Mass.

[73] Assignee: Gould Inc., Eastlake, Ohio

[21] Appl. No.: 372,665

[22] Filed: Jun. 28, 1989

[51] Int. Cl.[5] ..... H01H 85/30

[52] U.S. Cl. ..... 337/244; 337/267

[58] Field of Search ..... 337/244, 241, 265, 267

[56] References Cited

U.S. PATENT DOCUMENTS

| | | | |
|---|---|---|---|
| 3,281,555 | 10/1966 | Fister . | |
| 3,319,027 | 5/1967 | Hitchcock | 337/244 |
| 3,535,668 | 10/1970 | Cinquin | 337/244 |
| 3,657,679 | 4/1972 | Wilson | 337/244 |
| 3,671,910 | 6/1972 | Kozacka . | |
| 3,764,949 | 10/1973 | Swain . | |
| 3,783,428 | 1/1974 | Swain et al. . | |
| 3,824,520 | 7/1974 | Knapp, Jr. | 337/265 |
| 4,060,786 | 10/1977 | Cuzzone . | |
| 4,125,819 | 11/1978 | Jacobs, Jr. . | |

FOREIGN PATENT DOCUMENTS

| | | | |
|---|---|---|---|
| 420350 | 3/1967 | Switzerland | 337/244 |

*Primary Examiner*—H. Broome

*Attorney, Agent, or Firm*—Fish & Richardson

[57] ABSTRACT

An electric fuse constructed of a subassembly including a blown-fuse preassembly. The preassembly includes a stationary structure including an indicator housing having a chamber therein, an indicator pin mounted in the chamber for movement from a nonindicating position to an indicating position, an indicator spring mounted between the indicator housing and the indicator pin so as to bias the indicator pin from the nonindicating position to the indicating position, and a flexible indicator restraining wire having a first portion engaging the pin for restraint and, on respective sides of the first portion, second and third portions extending out of the indicator housing, the wire being in tension against force provided by the indicator spring to the indicator pin, the indicator wire restraining the pin in the nonindicating position and maintaining the spring cocked, the second and third portions being secured under tension by rigid bonding to the stationary structure. The subassembly includes a pair of insulator plate spacers, one of which carries the indicator housing, a pair of elongated conductors that are spaced by the plate spacers, and a multiple-element conductor array including a pair of spaced, substantially parallel, elongated base members and a plurality of substantially parallel fusible elements integral with and between the two base members, the base members being positioned in respective grooves in and being in electrical contact with the conductors.

28 Claims, 2 Drawing Sheets

ELECTRIC FUSE

BACKGROUND OF THE INVENTION

The invention relates to electric fuses and to preassemblies and subassemblies used in the construction of electric fuses.

Electric fuses are used to conduct current under normal conditions and to break a circuit under overload conditions, by the melting of fusible elements of the fuses. In some fuse applications, e.g., where the fusible elements are not visible, it is desirable to have a blown-fuse indicator that provides a visual indication that a fuse has blown.

Fister U.S. Pat. No. 3,281,555 discloses a fuse that includes a spring-loaded indicator pin that is restrained from movement and maintained in a cocked position by a restraining wire that is electrically connected in parallel with fusible elements between two conductor blades that extend from a fuse housing. The space in the housing between the fusible elements and the blades is filled with an arc quenching material (e.g., sand) that facilitates the extinguishing of arcs during fusing of the elements. The indicator pin is mounted within a metal indicator housing that is supported on an upper insulator plate between the conductor blades, and a lower insulator plate is used to anchor a tensioned end of the restraining wire.

Cuzzone U.S. Pat. No. 4,060,786 discloses an electric fuse with a spring-loaded, blown-fuse indicator mechanism having a restraining wire that is restrained and maintained under tension by friction between a plug and a mating bushing that seal off a hole of a cup formed in the end cap of the fuse.

Swaine U.S. Pat. No. 3,764,949 discloses an electric fuse in which fusible elements are provided as part of a multiple-element conductor array that is soldered within grooves of conductor strips after assembly of the strips into a fuse housing. A spring-loaded indicator mechanism is carried by a cap and restrained from movement by tensioned restraining wires that pass through the cavity in which the fusible elements are located.

Jacobs, Jr. U.S. Pat. No. 4,125,819 discloses a cylindrical fuse in which grooves in circular terminal plugs receive the ends of individual fusible elements that are joined together by insulator plates.

SUMMARY OF THE INVENTION

In one aspect, the invention features in general a blown-fuse indicator preassembly for use in constructing an electric fuse. The preassembly includes an indicator housing, a spring-loaded indicator pin that is mounted in a chamber in the indicator housing for movement from a nonindicating position to an indicating position, and a flexible indicator restraining wire that has a first portion that engages the pin for restraint and, on respective sides of the first portion, second and third portions that extend out of the indicator housing and are maintained under tension by rigid bonding to a stationary structure of the preassembly. The rigid bonding desirably retains the restraining wire without loosening even when the fuse is subjected to shock and vibration testing as required for military applications.

In preferred embodiments, it is desirable that the restraining wire be of multiple strands as opposed to a single strand of wire to avoid damaging the wire or altering its characteristics when it is placed under tension during assembly of the fuse; the indicator housing is mounted on an insulator plate that has a hole through it for passage of the wire, and the wire is rigidly bonded to the plate; the housing is mounted on one side of the plate so as to cover the hole, and there is a button on the other side of the plate that covers the hole; the button is sealed to the housing all the way around the hole; the first portion of the restraining wire located within the hole through the indicator pin where the indicator pin acts as a heat sink; and the second and third portions of the restraining wire are substantially parallel to the direction of the force applied by the indicator spring, and air space surrounds the lengths of the second and third portions which are contained in the housing so that these portions of the restraining wire are the ones that melt during overload.

In another aspect, the invention features in general a subassembly that is used in the construction of an electric fuse and results in greatly simplifying the construction. The subassembly includes a blown-fuse indicator preassembly that includes a first insulator plate spacer on which is mounted an indicator housing having a spring-loaded indicator pin and a flexible indicator restraining wire therein. The subassembly also includes a second insulator plate spacer that is substantially parallel to the first, a pair of elongated conductors that are substantially parallel to each other and are perpendicular to and spaced from each other by the two insulator plate spacers, and a multiple-element conductor array that includes a plurality of fusible elements that are electrically connected in parallel between the elongated conductors. The restraining wire of the preassembly is electrically connected to the elongated conductors in parallel with the fusible elements of the multiple-element conductor array.

In another aspect, the invention features in general an electric fuse subassembly for insertion into a fuse housing having slots to receive plug-in blades. This subassembly includes a pair of rigid elongated conductors and a multiple-element conductor array. The elongated conductors have linear extensions that comprise plug-in blades spaced for insertion into the slots of the fuse housing and respective elongated surfaces that face each other and have respective grooves along the surfaces. The multiple-element conductor array includes a pair of spaced, substantially parallel, elongated base members and a plurality of substantially parallel fusible elements that are integral with and between the two base members. The two base members are positioned in the respective grooves of the conductors and are in electrical contact with the conductors.

In the preferred embodiments, the grooves of the conductors coverage in width from the surface of the elongated conductors to the bottoms of the groove in order to properly position the base members; the multiple element array is made by stamping a sheet of metal; there are glass melamine spacers between the elongated conductors; and the fuse is a vibration and shock resistant, current-limiting power fuse including a pulverulent arc-quenching filler within the fuse housing embedding the fusible elements therein.

Other advantages and features of the invention will be apparent from the following description of the preferred embodiment thereof and from the claims.

DESCRIPTION OF THE PREFERRED EMBODIMENT

The preferred embodiment will now be described.

DRAWINGS

STRUCTURE

Figure 1:
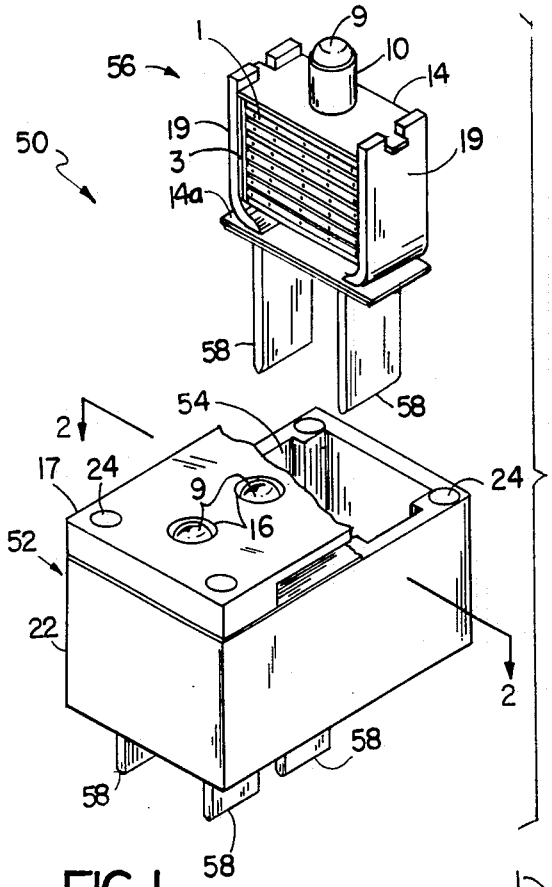
FIG. 1 is a perspective view, partially broken away and exploded, of an electric fuse according to the invention.
Figure 2:
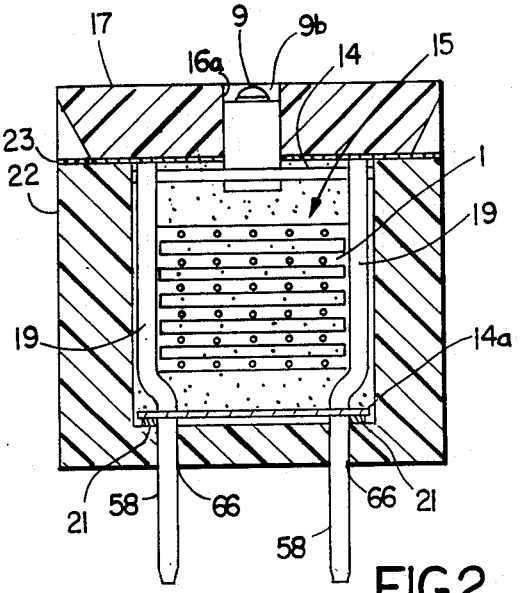
FIG. 2 is a vertical sectional view, taken at 2—2 of FIG. 1, of the FIG. 1 electric fuse.

Referring to FIGS. 1 and 2, electric fuse 50 includes housing 52, which has base 22 and cover 17 (both made of glass reinforced thermoset polyester) to define three fuse chambers 54 for receiving three subassemblies 56. (Only one chamber 54 and one subassembly 56 are shown in FIG. 1.) Each subassembly 56 has a pair of spaced apart, elongated conductors 19 (made of silver plated copper) that have linear extensions that comprise plug-in blades 58 for making electrical connection with external circuitry. Each subassembly 56 also includes a pair of multiple-element arrays 1 (see FIG. 4) that each have a plurality of parallel, fusible elements 3 connected between elongated conductors 19. Subassembly 56 also includes a pair of insulator plate spacers 14, 14*a* (electrical, GME, material) that act to space elongated conductors 19. Upper insulator plate 14 supports indicator housing 10 (made of nylon 6/6), which houses spring-biased indicator pin 9 (made of GME Grade 5). The upper ends of indicator pins 9 are aligned with holes 16 of cover 17 and have converging upper end portions 9*b* in order to guide pins 9 through holes 16 during upward travel. Upper gasket 23 provides a seal between cover 17 and base 22. Each plug-in blade 58 has a bottom gasket 21 that provides a seal between the bottom surface of spacer 14*a* and the floor of base 22 around slots 66 through which blades 58 pass. The gaskets are silicone rubber grade 50. The spaces within chambers 54 are filled with sand 15 (50/70 U.S. sieve size quartz), which embeds fusible elements 3 and functions as a pulverulent, arc-quenching filler. Bolts (not shown) in holes 24 are used to secure cover 17 to base 22.

Figure 3:
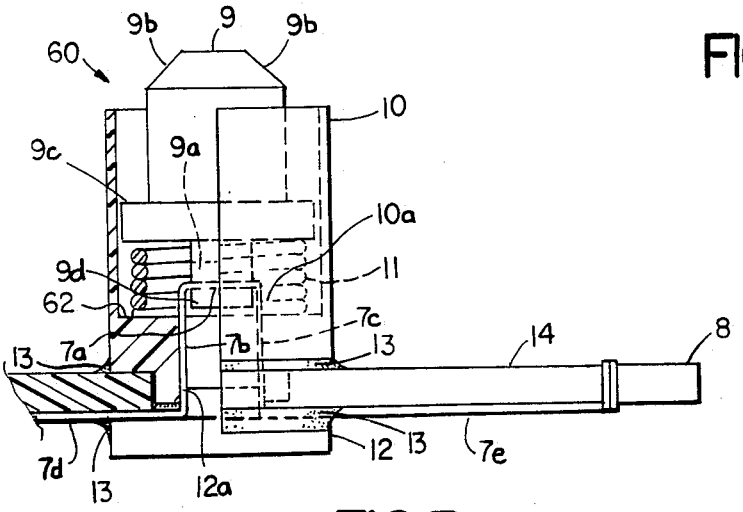
FIG. 3 is a vertical sectional view, partially broken away, of a preassembly used in constructing the FIG. 1 fuse.
Figure 3A:
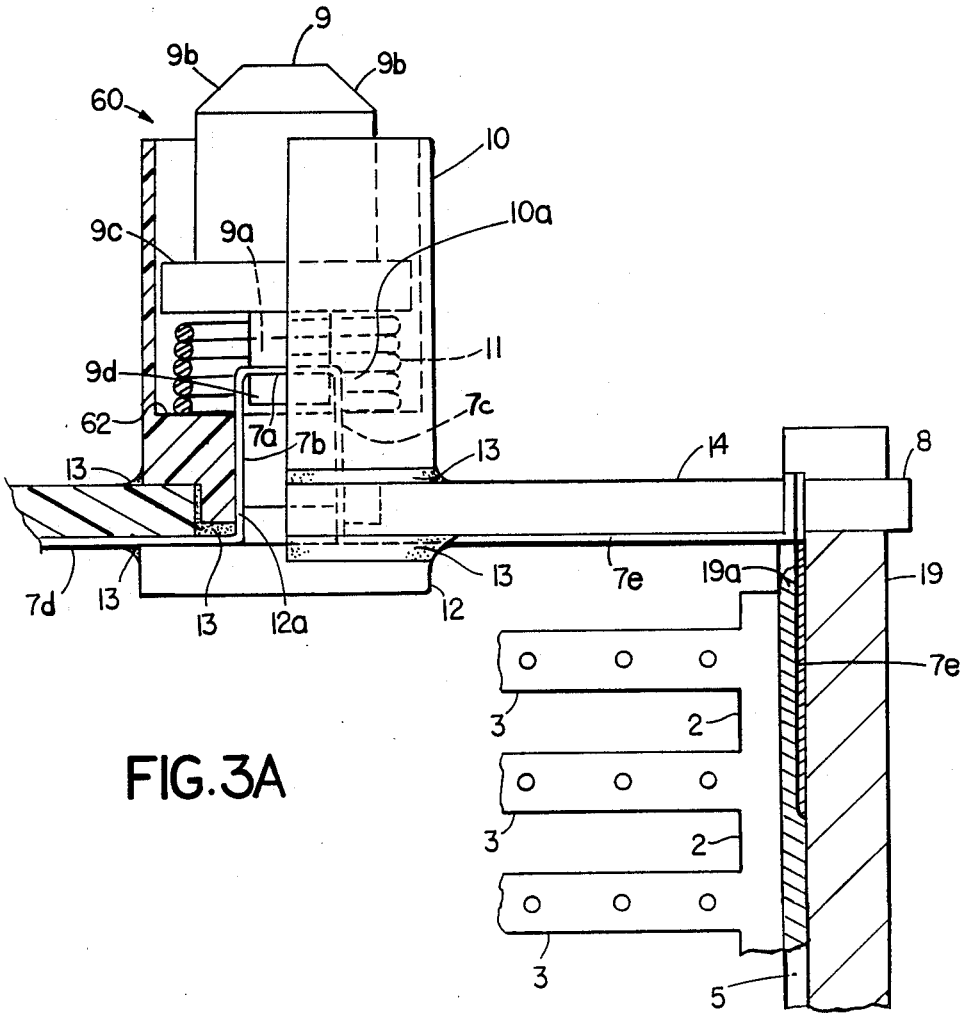
FIG. 3A is a vertical sectional view showing the FIG. 3 preassembly connected to an elongated conductor in a subassembly of the FIG. 1 fuse.
Figure 3B:
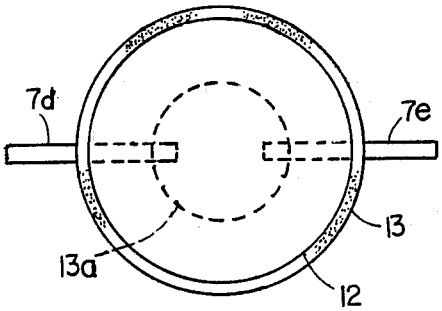
FIG. 3B is a bottom plan view of a button and associated wires and epoxy sealing material of the FIG. 3 preassembly.

Referring to FIGS. 3, 3A and 3B, preassembly 60, which is used in construction of subassembly 56, is shown. It includes a stationary structure that includes indicator housing 10 and upper insulator plate spacer 14, which acts as a support for indicator housing 10. Preassembly 60 also includes movable indicator pin 9, indicator spring 11 (stainless steel 302), and restraining wire 7 (seven-strand, cadmium chromium copper alloy SP-135, unplated, available from Hudson wire company, Ossining, N.Y.). Indicator spring 11 acts between flange portion 9*c* of pin 9 and floor 62 of housing 10. Pin 9 also has lower extension 9*d* with horizontal hole 9*a* through which first portion 7*a* of indicator restraining wire 7 passes. Indicator wire 7 also has second and third portions 7*b* and 7*c* that pass through housing 10 and are rigidly bonded between the lower surface of insulator plate spacer 14 and the facing surface of button 12 (made of nylon 6/6) by epoxy 13 (available from Emerson & Cuming under the Stycast 2651-40 trade designation with Catalyst 11). The outer diameter of upper portion 12*a* of button 12 is 0.14"; the inner diameter of the mating bore of housing 10 is 0.144", and the nominal diameter of seven-strand wire 7 is 0.00925". These dimensions and tolerances assure that wire 7 is not damaged by pinching between the mating portions of button 12 and housing 10. Fourth and fifth portions 7*d* and 7*e* of wire 7 are end portions of the wire that electrically connect the second and third portions to elongated conductors 19. The ends of the fourth and fifth portions 7*d* and 7*e* of wire 7 are wrapped twice around extension 8 of a top insulator plate spacer 14 and then proceed about one-third of the way down grooves 5 in elongated conductor blades 19, as is described in more detail below. Portions 7*b* and 7*c* of restraining wire 7 are in tension against force provided by indicator spring 11 to indicator pin 9 and restrain pin 9 in the nonindicating position shown in the drawings and maintain the spring cocked. Epoxy 13 rigidly bonds wire 7 between facing surfaces of button 12 and spacer 14 and provides a seal between the two all around the hole in spacer 14. This acts to positively anchor wire 7 without physically damaging wire 7. The positive anchoring assures that the wire is not released by creep as a result of vibration and other movements of the fuse during the life of the fuse. Indicator pin 9 includes a converging portion 9*b* in order to guide pin 9 through hole 16 during upward travel. Flange 16*a* of cover 17 is used to prevent pin 9 from being ejected from housing 52.

Figure 4:
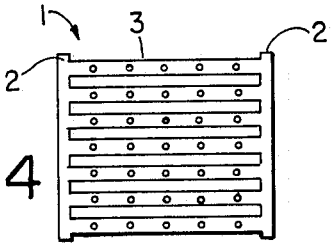
FIG. 4 is a elevation showing a multiple-element array of fusible elements used in the FIG. 1 fuse.
Figure 5:
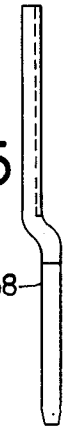
FIG. 5 is a side elevation of an elongated conductor used in the FIG. 1 fuse.
Figure 6:
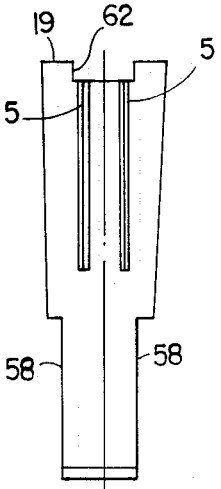
FIG. 6 is a front elevation of the FIG. 5 conductor.

Referring to FIGS. 4 through 6, multiple-element conductor array 1 (made of silver, grade A) includes two parallel base members 2 and parallel fusible elements 3 therebetween. Each conductor blade 19 has a notch 62 in its upper surface for receiving extensions 8 of first insulator plate spacer 14 and two vertical v-grooves 5 for receiving base members 2.

In construction of fuse 50, preassembly 60 is first made by threading wire 7 and feeding it through spring 11, housing 10, and the hole in first insulator spacer 14. A bead of epoxy (Stycast 2651-40 with Catalyst 11) is placed around the circumference of the hole in spacer 14. Second and third portions, 7*b* and 7*c* of wire 7, of the restraining wire are pulled in tension against spring 11. While in tension, button 12 is inserted into the hole located in spacer 14 making intimate contact with epoxy 13 to seal the hole in spacer 14 and housing 10. The second and third portions 7*b* and 7*c* of wire 7 are then rigidly bonded to first insulator plate spacer 14 by the annular layer 13*a* of epoxy provided between facing surfaces of plate spacer 14 and button 12. The end portions 7*d* and 7*e* of wire 7 are then wrapped around extensions 8 of first insulator plate spacer 14. Preassembly 60 is then used to make subassembly 56. This involves soldering the ends of wire portions 7*d*, 7*e* and base members 2 of multiple-element conductor array 1 in grooves 5 at the same time. The distances along portions 8*d*, 8*e* between solder 19*a* in grooves 5 and bending at extensions 8 are sufficiently long so as to prevent heat due to soldering from affecting the restraining wire where wire 7 bends around extensions 8 and resultant weakening of wire 7 at those locations. Lower insulator plate 14*a* and gaskets 21 are threaded onto respective plug-in blades 58. Subassemblies 56 are then placed in respective chambers 54, and their plug-in blades 58 are inserted through slots 66 in base 22. Cavities 54 are then filled with sand, and upper gasket 23 and cover 17 are secured to the bodies by bolts provided in holes 24.

Operation

Fuse 50 is typically used in conjunction with a circuit breaker (e.g., Navy type AQB-A101 and NQB-A101 available from SPD TECHNOLOGIES, PHILADELPHIA, PENNA.). The circuit breaker (not shown) opens in response to relatively small overload conditions, and fuse 50 opens in response to much larger, and very-fast overload conditions that would otherwise destroy the circuit breaker before the circuit breaker had time to act. During normal current operation, each fuse module corresponding to a subassembly 56 conducts current; because multiple element arrays 1 have much lower resistance than restraining wire 7, they conduct most of the current. Under short circuit conditions, the higher current causes fusible elements 3 of a multiple-element array 1 to melt and open up. The associated indicator wire 7 then carries the bulk of the current for a very short duration, and the wire itself fuses at portions 7*b*, 7*c* inside housing 10 in air space 10*a*. In doing so, it releases indicator pin 9, and spring 11 ejects the indicator pin upward so that its upper portion passes through hole 16 in top cover 17. This provides a visual indication that the module has blown.

Lower gaskets 21 and upper gasket 23 prevent the sand from leaking out of fuse 50 and also prevent the pressure and gases from being released from the fuse under short circuit conditions. The epoxy seal between button 12 and the lower surface of upper insulator plate spacer 14 prevents sand from entering chamber 10*a*, where it might inhibit operation of the blown-fuse indicator mechanism. The loss of filler material from chamber 54 is to be avoided as this would adversely affect the designed current-limiting characteristics of the fuse such that the fuse, circuit breaker and/or interconnected equipment could sustain damage during short circuit conditions. The use of glass melamine material for insulator plate spacers 14, 14*a* provides dimensional stability under heat and moisture conditions, avoiding deformation and possible resulting voids in the filler. The use of multiple-strand wire acts to avoid reducing its strength where it is bent during assembly. Also by tensioning only wire portions 7*b*, 7*c*, tension is avoided on the rest of the structure, thereby facilitating ease of manufacture.

The use of insulating material for housing 10 avoids current conducting members near the outer surface with fuse 50.

Other Embodiments

Other embodiments of the invention are within the scope of the following claims.

What is claimed is:

1. A blown-fuse indicator preassembly comprising a stationary structure including an indicator housing having a chamber therein, an indicator pin mounted in said chamber for movement from a nonindicating position to an indicating position, an indicator spring mounted between said indicator housing and said indicator pin so as to bias said indicator pin from said nonindicating position to said indicating position, and a flexible indicator restraining wire having a first portion engaging said pin for restraint and, on respective sides of the first portion, second and third portions extending out of the indicator housing, said wire being in tension against force provided by said indicator spring to said indicator pin, said indicator wire restraining said pin in said nonindicating position and maintaining said spring cocked, said second and third portions being secured under tension by rigid bonding to said stationary structure.

2. The preassembly of claim 1 wherein said flexible indicator restraining wire is comprised of multiple strands.

3. The preassembly of claim 1 wherein said stationary structure includes a support on which said housing is mounted, and wherein said second and third portions of said wire are rigidly bonded to said support.

4. The preassembly of claim 3 wherein said support is an insulator plate having a hole therethrough for passage of said wire.

5. The preassembly of claim 4 wherein said housing is mounted on one side of said plate so as to cover said hole and further comprising a button mounted on the other side of said plate so as to cover said hole, said plate and said button having facing surfaces surrounding said hole, said second and third portions passing between and being rigidly bonded to said facing surfaces.

6. The preassembly of claim 5 wherein said button is bonded to said plate at said facing surfaces all the way around said hole so as to provide a seal between the two around said hole.

7. The preassembly of claim 1 wherein said second and third portions are substantially parallel to the direction of said force applied by said indicator spring to said indicator pin, and air space surrounds the lengths of said second and third portions which are contained within said housing.

8. An electric fuse subassembly comprising a blown-fuse indicator preassembly including a stationary structure including a first insulator plate spacer on which is mounted an indicator housing having a chamber therein, an indicator pin mounted in said chamber for movement from a nonindicating position to an indicating position, an indicator spring mounted between said indicator housing and said indicator pin so as to bias said indicator pin from said nonindicating position to said indicating position, and a flexible indicator restraining wire having a first portion engaging said pin for restraint and, on respective sides of the first portion, second and third portions extending out of the indicator housing, said wire being in tension against force provided by said indicator spring to said indicator pin, said indicator wire restraining said pin in said nonindicating position and maintaining said spring cocked, said second and third portions being secured under tension by rigid bonding to said stationary structure, a second insulator plate spacer that is substantially parallel to and spaced from said first insulator plate spacer, a pair of elongated conductors that are substantially parallel to each other and are substantially perpendicular to and spaced from each other by said first and second insulator plate spacers, said indicator wire including fourth and fifth portions that electrically connect respective second and third portions of said indicator wire to respective said elongated conductors, and a multiple-element conductor array that includes a plurality of fusible elements electrically connected in parallel between said elongated conductors.

9. The subassembly of claim 8 wherein said flexible indicator restraining wire is comprised of multiple strands.

10. The subassembly of claim 8 wherein said first insulator plate spacer has a hole therethrough for passage of said wire.

11. The subassembly of claim 10 wherein said housing is mounted on one side of said first insulator plate spacer so as to cover said hole and further comprising a button mounted on the other side of said first insulator plate spacer so as to cover said hole, said first insulator plate spacer and said button having facing surfaces surrounding said hole, said second and third portions of said wire passing between and being rigidly bonded to said facing surfaces.

12. The subassembly of claim 11 wherein said button is bonded to said first insulator plate spacer at said facing surfaces all the way around said hole so as to provide a seal between the two around said hole.

13. The subassembly of claim 12 wherein said second and third portions are substantially parallel to the direction of said force applied by said indicator spring to said indicator pin, and air space surrounds the lengths of said second and third portions which are contained within said housing.

14. An electric fuse subassembly for insertion into a fuse housing having slots to receive plug-in blades, the subassembly comprising a pair of rigid, elongated conductors having linear extensions that comprise plug-in blades spaced for insertion into said slots in said housing, said conductors being substantially parallel to each other, each said conductor having a respective elongated surface that faces the respective surface of the other, each said surface having a respective groove along said surface, and a multiple-element conductor array including a pair of spaced, substantially parallel, elongated base members and a plurality of substantially parallel fusible elements integral with and between the two base members, said base members being positioned in respective said grooves in electrical contact with said conductors.

15. The subassembly of claim 14 wherein each said groove converges in width from its respective surface to a bottom of said groove.

16. The subassembly of claim 14 wherein said array is made by stamping a sheet of metal.

17. The subassembly of claim 14 wherein said elongated conductors are blades.

18. The subassembly of claim 14 further comprising glass melamine spacers between said elongated conductors.

19. An electric fuse comprising a fuse subassembly including a pair of rigid, elongated conductors having linear extensions that comprise plug-in blades spaced for insertion into said slots in said housing, said conductors being substantially parallel to each other, each said conductor having a respective elongated surface that faces the respective surface of the other, each said surface having a respective groove along said surface, and a multiple-element conductor array including a pair of spaced, substantially parallel, elongated base members and a plurality of substantially parallel fusible elements integral with and between the two base members, said base members being positioned in respective said grooves in electrical contact with said conductors, and further comprising a fuse housing having slots receiving said plug-in blades, an indicator preassembly, and first and second insulator plate spacers that are between and space said elongated conductors, the first said insulator plate spacer being part of a stationary structure of said indicator preassembly, the stationary structure also including an indicator housing having a chamber therein, the indicator preassembly also including an indicator pin mounted in said chamber for movement from a nonindicating position to an indicating position, an indicator spring mounted between said indicator housing and said indicator pin so as to bias said indicator pin from said nonindicating position to said indicating position, and a flexible indicator restraining wire having a first portion engaging said pin for restraint and, on respective sides of the first portion, second and third portions extending out of the indicator housing, said wire being in tension against force provided by said indicator spring to said indicator pin, said indicator wire restraining said pin in said nonindicating position and maintaining said spring cocked, said second and third portions being secured under tension by rigid bonding to said stationary structure, said indicator wire including fourth and fifth portions that electrically connect respective second and third portions of said indicator wire to respective said elongated conductors.

20. The fuse of claim 19 wherein said indicator restraining wire is comprised of multiple strands.

21. The fuse of claim 19 wherein said fourth and fifth portions are soldered in respective said grooves.

22. The fuse of claim 21 wherein the solder that joins and electrically connects said fourth and fifth portions to said elongated conductors also joins and electrically connects said base members of said multiple-element conductor array to said elongated conductors.

23. The fuse of claim 21 wherein said fuse housing has a cover with an opening, said indicator pin extending into said opening when in said indicating position.

24. The fuse of claim 19 wherein said fuse is a vibration and shock resistant, current-limiting power fuse including a pulverulent arc-quenching filler within said housing embedding said fusible elements therein.

25. The fuse of claim 20 wherein said first insulator plate spacer has a hole therethrough for passage of said wire, wherein said indicator housing is mounted on one side of said first insulator plate spacer so as to cover said hole and further comprising a button mounted on the other side of said first insulator plate spacer so as to cover said hole, said first insulator plate spacer and said button having facing surfaces surrounding said hole, said second and third portions passing between and being bonded to said facing surfaces, and wherein said button is bonded to said first insulator plate spacer at said facing surfaces all the way around said hole so as to provide a seal between the two around said hole.

26. The preassembly of claim 1 wherein said indicator housing is made of insulating material.

27. The subassembly of claim 8 wherein said indicator housing is made of insulating material.

28. The fuse of claim 19 wherein said indicator housing is made of insulating material.

* * * * *